US010690344B2

(12) United States Patent
Tynkov et al.

(10) Patent No.: US 10,690,344 B2
(45) Date of Patent: Jun. 23, 2020

(54) BOILER SYSTEM AND METHOD OF OPERATING SAME

(71) Applicant: Cleaver-Brooks, Inc., Thomasville, GA (US)

(72) Inventors: Boris M. Tynkov, Bayside, WI (US); Rakesh Zala, Germantown, WI (US); Randy Todd Aicher, Muskego, WI (US)

(73) Assignee: Cleaver-Brooks, Inc., Milwaukee, WI (US)

( * ) Notice: Subject to any disclaimer, the term of this patent is extended or adjusted under 35 U.S.C. 154(b) by 373 days.

(21) Appl. No.: 15/138,899

(22) Filed: Apr. 26, 2016

(65) Prior Publication Data

US 2017/0307215 A1 Oct. 26, 2017

(51) Int. Cl.
*F23N 5/00* (2006.01)
*F23C 9/06* (2006.01)
(Continued)

(52) U.S. Cl.
CPC ..... *F23N 5/003* (2013.01); *F23C 7/008* (2013.01); *F23C 9/06* (2013.01); *F23J 15/00* (2013.01); *F23N 3/002* (2013.01)

(58) Field of Classification Search
CPC ..... F23C 9/06; F23C 9/08; F23N 2900/05003
See application file for complete search history.

(56) References Cited

U.S. PATENT DOCUMENTS 4,659,305 A 4/1987 Nelson et al.
4,995,807 A 2/1991 Rampley et al.
(Continued)

FOREIGN PATENT DOCUMENTS

DE 3832322 A1 3/1990
SU 1751607 A1 2/1990
WO 03/034819 A2 5/2003

OTHER PUBLICATIONS

"Practical issues of combustion oxygen measurement specifically related to NOx emissions" Jim Scott, Bobby Dennis, white paper of Yokogawa 2013 (Year: 2013).*
(Continued)

*Primary Examiner* — Avinash A Savani
*Assistant Examiner* — Martha M Becton
(74) *Attorney, Agent, or Firm* — SmithAmundsen LLC

(57) ABSTRACT

Boiler systems and associated control systems, methods for operating same, are described herein. In one example embodiment, a boiler system includes a furnace, an exhaust passage, an air passage, a FGR passage, a flue gas valve that is adjustable by way of a first actuator, a $NO_X$ gas sensor, an oxygen gas sensor, and an additional valve that is adjustable by way of a second actuator. Further, the boiler system includes at least one processing device coupled to the $NO_X$ gas sensor, the oxygen gas sensor, the first actuator and the second actuator. The at least one processing device is configured to generate control signals that are provided to the first actuator and second actuator, and also configured to generate correction factors by way of a calibration process and to utilize one or more of the correction factors in determining one or more of the control signals.

18 Claims, 5 Drawing Sheets

(51) Int. Cl.

| | |
|---|---|
| ***F23C 7/00*** | (2006.01) |
| ***F23J 15/00*** | (2006.01) |
| ***F23N 3/00*** | (2006.01) |

(56) References Cited

U.S. PATENT DOCUMENTS

| | | | | | |
|---|---|---|---|---|---|
| 5,002,484 | A * | 3/1991 | Lofton | F22B 35/002 | 110/188 |
| 5,040,470 | A * | 8/1991 | Lofton | F22B 35/002 | 110/188 |
| 5,195,883 | A | 3/1993 | Hanna et al. | | |
| 5,237,939 | A | 8/1993 | Spokoyny et al. | | |
| 5,259,342 | A * | 11/1993 | Brady | F22B 21/26 | 110/234 |
| 5,315,941 | A | 5/1994 | Vetterick et al. | | |
| 5,333,574 | A | 8/1994 | Brady et al. | | |
| 5,433,174 | A | 7/1995 | Brady et al. | | |
| 5,471,957 | A | 12/1995 | Brady et al. | | |
| 5,539,638 | A * | 7/1996 | Keeler | F02D 41/1401 | 123/672 |
| 5,569,312 | A * | 10/1996 | Quirk | C03B 5/237 | 65/134.6 |
| 5,573,568 | A * | 11/1996 | Quirk | B01D 53/56 | 65/134.6 |
| 5,609,124 | A | 3/1997 | Leclerc | | |
| 5,638,773 | A | 6/1997 | Brady et al. | | |
| 5,732,664 | A * | 3/1998 | Badeaux, Jr. | F22B 35/00 | 122/1 R |
| 6,039,560 | A * | 3/2000 | Kubota | F23C 9/08 | 110/345 |
| 6,073,591 | A | 6/2000 | Theriault | | |
| 6,146,604 | A | 11/2000 | Kiiskila et al. | | |
| 6,171,100 | B1 | 1/2001 | Joshi et al. | | |
| 6,325,002 | B1 | 12/2001 | Ashworth | | |
| 6,517,793 | B1 | 2/2003 | Tamminen et al. | | |
| 6,599,119 | B1 | 7/2003 | Wood et al. | | |
| 6,609,907 | B1 | 8/2003 | Wood et al. | | |
| 6,666,086 | B2 | 12/2003 | Colman et al. | | |
| 7,032,388 | B2 * | 4/2006 | Healy | F02C 9/28 | 60/772 |
| 7,913,632 | B2 * | 3/2011 | Jia | F23D 1/00 | 110/265 |
| 7,966,080 | B2 | 6/2011 | Jia et al. | | |
| 8,230,825 | B2 | 7/2012 | Knorr, Jr. | | |
| 8,244,505 | B2 * | 8/2012 | Headley | F23N 5/006 | 703/2 |
| 8,578,892 | B2 * | 11/2013 | D'Agostini | F23L 7/007 | 122/4 D |
| 2002/0108440 | A1 | 8/2002 | Colman et al. | | |
| 2004/0181349 | A1 * | 9/2004 | Tynkov | F22B 35/18 | 702/55 |
| 2005/0056313 | A1 * | 3/2005 | Hagen | B01F 5/0453 | 137/3 |
| 2005/0257721 | A1 * | 11/2005 | Okazaki | F23C 6/045 | 110/204 |
| 2007/0113560 | A1 * | 5/2007 | Steber | F23N 5/003 | 60/773 |
| 2007/0168083 | A1 | 7/2007 | Thulen et al. | | |
| 2008/0163758 | A1 | 7/2008 | Jeong et al. | | |
| 2009/0025655 | A1 * | 1/2009 | Tanaka | B01D 53/8625 | 122/14.21 |
| 2009/0125155 | A1 | 5/2009 | Hill et al. | | |
| 2009/0151206 | A1 | 6/2009 | Cai et al. | | |
| 2010/0241249 | A1 * | 9/2010 | Jia | G05B 13/048 | 700/29 |
| 2010/0280665 | A1 | 11/2010 | Fildes et al. | | |
| 2011/0106506 | A1 * | 5/2011 | Headley | F23N 5/006 | 703/2 |
| 2012/0286054 | A1 | 11/2012 | Collins | | |
| 2013/0042822 | A1 * | 2/2013 | Fioriti | F23N 5/006 | 122/14.21 |
| 2014/0114483 | A1 | 4/2014 | Haugstetter | | |
| 2015/0210947 | A1 * | 7/2015 | Parson | C10L 1/12 | 60/39.465 |
| 2016/0370030 | A1 * | 12/2016 | Zala | F24H 1/205 | |

OTHER PUBLICATIONS

C.E. Baukal & P.B. Eleazer (1998) Quantifying NOx for Industrial Combustion Processes, Journal of the Air & Waste Management Association, 48:1, 52-58, DOI: 10.1080/10473289.1998.10463664; 2011 (Year: 2011).*

Cleaver Brooks, CBRA New Products Committee Meeting presentation, Jun. 19, 2014.

Cleaver Brooks, CBRA New Products Committee Meeting presentation, Jul. 30, 2015.

* cited by examiner 500
546
STACK OUTLET
534
536
NOx AND O2
SENSING AND
CONTROL MODULE 550
FGR DUCT
539
552
538
548
530
559
BOILER TUBES
516
REAR TUBE SHEET
532
554
FGR VALVE
540
506
530
504
524
REAR DOOR
512
549
GUN
BURNER
508
510
AIR VALVE
509
542
AIR INLET
544
560
561
518
FUEL VALVE
522
520
FURNACE
514

BOILER SYSTEM AND METHOD OF OPERATING SAME

CROSS-REFERENCE TO RELATED APPLICATIONS

--

FIELD OF THE INVENTION

The present invention relates to boiler systems or other heating systems that employ combustion processes and, more particularly, to boiler systems or other heating systems and related methods of operation by which system operation can be controlled to achieve desired performance levels in regard to one or more of a variety of characteristics including, for example, controlled to reduce or avoid undesirable $NO_X$ levels, and/or in which system operation involves a calibration process or subprocess.

BACKGROUND

Heating systems that employ combustion processes to generate heat, such as boiler systems, are commonly employed in a variety of environments. Although conventional systems often can attain high levels of performance in regard to various criteria, there nevertheless are areas of performance where improvements would be desirable. For example, conventional boiler systems typically emit combustion emissions in the form of flue gas that can include levels of nitrogen monoxide/nitrogen dioxide ($NO_X$) and, notwithstanding efforts that have been made to achieve control over the generation and emission of $NO_X$, there remains a need for enhanced performance in this regard. Also for example, conventional boiler systems can experience contaminant buildup within the portions of the systems that communicate water or other fluid that is heated (or boiled) during operation. To minimize or avoid problems associated with such contaminant buildup, conventional boilers typically periodically (e.g., one time per day or per shift) flush out the boiler. However, such flushing operation tends to waste heat.

In view of one or more of such limitations that exist in relation to conventional heating systems such as boiler systems, it would be advantageous if one or more improvements could be achieved in relation to such boiler systems or other heating systems and related methods of operation.

SUMMARY

The present disclosure in at least some embodiments relates to a boiler system. The boiler system includes a furnace with a burner, at which flue gas is generated as a result of combustion, and an exhaust passage by which at least a first portion of the flue gas can exit the furnace. Also, the boiler system includes an air passage configured to receive ambient air, and a flue gas recirculation (FGR) passage configured to allow for at least a second portion of the flue gas to be mixed with the ambient air so as to produce combustion air. Further, the boiler system includes a flue gas valve that is positioned along the FGR passage and adjustable by way of a flue gas valve actuator, a NOX gas sensor and an oxygen gas sensor, and an additional valve adjustable by way of an additional valve actuator and configured to control a flow of the combustion air to the burner. Additionally, the boiler system includes at least one processing device coupled to the NOX gas sensor, the oxygen gas sensor, the flue gas valve actuator, and the additional valve actuator, where the at least one processing device is configured to generate a plurality of control signals that are provided to the flue gas valve actuator and additional valve actuator based at least indirectly upon a plurality of sensor signals received from the NOX gas sensor and oxygen gas sensor. Further, the at least one processing device additionally is configured to generate a plurality of correction factors by way of a calibration process and to utilize one or more of the correction factors in determining one or more of the control signals.

In at least some additional embodiments, the present disclosure relates to a method of operating a boiler system. The method includes performing a calibration process by way of at least one processing device to determine one or more correction factors. Also the method includes operating a blower to direct gases including both ambient air and flue gas toward a burner assembly of the boiler system, and performing combustion within the burner assembly. Further, the method includes receiving at least some additional flue gas at an exhaust passage, sensing a $NO_X$ gas concentration in the additional flue gas at or near a boiler outlet by way of a $NO_X$ gas sensor, and sensing an oxygen gas concentration in the additional flue gas at or near the boiler outlet by way of an oxygen gas sensor. Additionally, the method includes receiving, at the at least one processing device, a first sensor signal and a second sensor signal respectively from the $NO_X$ gas sensor and the oxygen gas sensor, respectively, which are indicative of the $NO_X$ gas concentration and the oxygen gas concentration, respectively. Also, the method includes selecting a first of the one or more correction factors based upon a first level of moisture that is present, and generating a plurality of control signals at the at least one processing device based at least indirectly upon the first and second sensor signals, where at least one of the control signals is generated based at least in part upon the selected first correction factor. Further, the method includes sending either a first of the control signals or a first additional control signal based at least indirectly upon the first control signal to a flue gas valve positioned along a flue gas recirculation passage coupled at least indirectly with the blower so as to adjust a first status of the flue gas valve and thereby adjust a first amount of the additional flue gas that is supplied to the blower, and sending either a second of the control signals or a second additional control signal based at least indirectly upon the second control signal to an additional valve so as to adjust a second amount of additional ambient air supplied to the blower.

Additionally, in at least some further embodiments, the present disclosure relates to a control system for a boiler system. The control system includes at least one processing device, and a memory device coupled at least indirectly to the at least one processing device. Also, the control system includes a $NO_X$ gas sensor at least indirectly coupled to the at least one processing device and configured to provide a first sensor signal indicative of a sensed $NO_X$ gas concentration, and an oxygen gas sensor at least indirectly coupled to the at least one processing device and configured to provide a second sensor signal indicative of a sensed oxygen gas concentration. Further, the control system includes a flue gas valve actuator coupled at least indirectly to the at least one processing device, and an ambient air valve actuator coupled at least indirectly to the at least one processing device. The at least one processing device is configured to generate first and second control signals at least indirectly based upon the first and second sensor signals and to transmit the first and second control signals respectively to the flue gas valve actuator and the ambient air valve actuator, respectively, so as to cause the flue gas valve actuator and the ambient air valve actuator, respectively, to be actuated. Either the first control signal or the second control signal is generated at least indirectly based upon both of the first and second sensor signals, and further based upon at least one correction factor determined at least partly based upon fuel data provided by a fuel sensor.

DETAILED DESCRIPTION

The present disclosure is intended to encompass numerous different types of boiler and other heating systems and arrangements, including fire tube boiler systems with integral burners, gun burner boiler systems with gun burners, or water tube boiler systems, which operate in a "smart" manner in which one or more characteristics of system operation are controlled or varied based upon sensed information or otherwise in order to achieve various desired operational goals. At least some such embodiments involve a boiler system that utilizes flue gas oxygen ($O_2$) and $NO_X$ concentration sensors housed in a common enclosure, where the sensors are mounted within the flue gas stream as it exits the boiler system. Initial positions of combustion air and flue gas recirculation (FGR) valves (or initial positions of ambient air and FGR valves) can be controlled based upon heat demand (or load).

Further, in such embodiments, a controller (or controllers) associated with the boiler system provide corrections to output (or control) signals employed to govern settings of the combustion air and FGR valves (or other valves). Correction for the combustion air control output can be particularly based upon the oxygen concentration in the flue gas, and correction for the FGR control output can be particularly based on $NO_X$ concentration in the flue gas. Optimum oxygen and $NO_X$ concentrations are determined during boiler commissioning with individual set points through the full modulation range of the burner. In some embodiments, cascade-type control operations can be implemented. The system can also have a start-up routine to position both the air and FGR dampers to the proper positions. The start-up (warm-up) routine makes adjustments that in some embodiments can be based upon flue gas and boiler water temperature. Additionally, in at least some embodiments above, the boiler systems perform a calibration process or subprocess based upon which, at least in part, control factors are generated that in turn, at least in part, influence the output (or control) signals governing the settings of the combustion air and FGR valves (or other valves).

Figure 1:
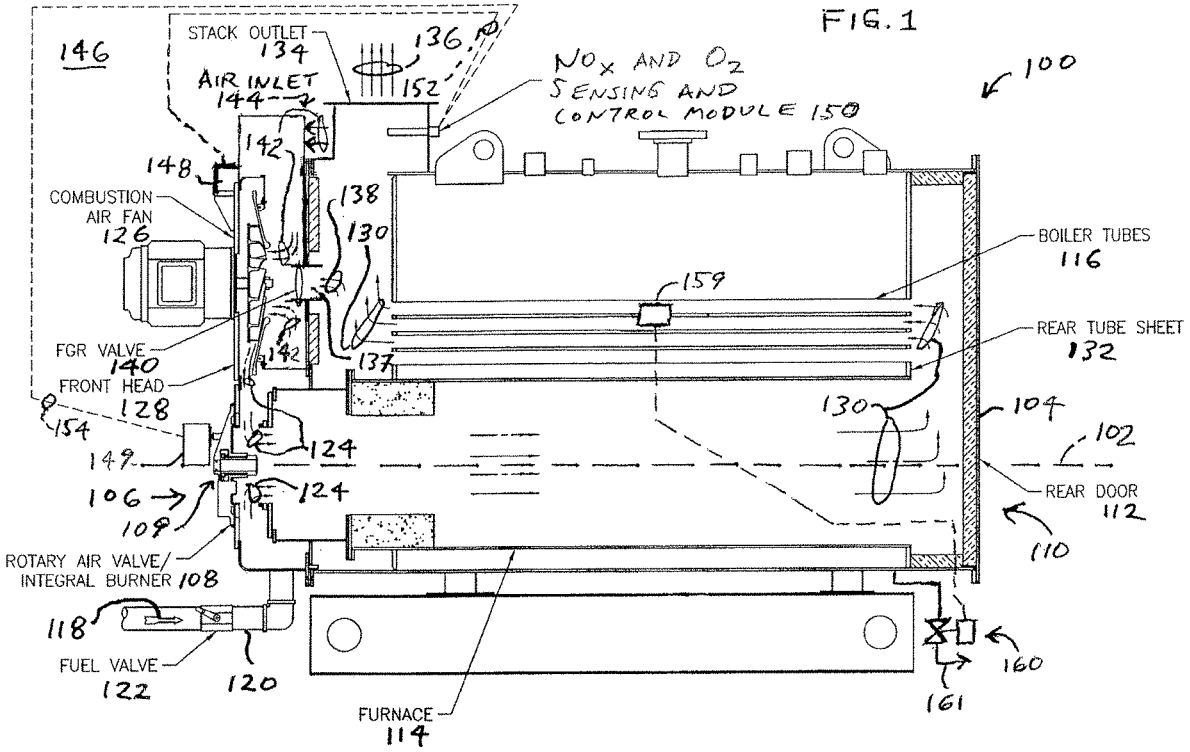
FIG. 1 is a schematic diagram showing an example boiler system, which in this example is an integral fire tube boiler system, in accordance with one example embodiment encompassed herein.

Referring to FIG. 1, a boiler system 100 in accordance with one example embodiment of the present disclosure is shown in schematic form, with portions of the boiler system shown in a cross-section taken along a vertical plane extending through a central axis 102 of the boiler system. In the present embodiment, the boiler system 100 is a fire tube boiler system that is an integral burner boiler system having an integral burner arrangement. As shown, the boiler system 100 includes a housing 104 with a front end 106 at which is located a rotary air valve/integral burner 108 including an electrically-actuated damper 109, a rear end 110 at which is located a rear door 112 of the housing 104, and a combustion chamber or furnace 114 positioned between the front and rear ends.

Additionally, the boiler system 100 also includes a plurality of boiler tubes 116, which are positioned along and above (or around) the furnace 114, and which contain combustion gases that can flow through the tubes. During operation of the boiler system 100, heat arising from the combustion occurring within the furnace 114 and flow of combustion gases through the tubes 116 heats water within the boiler system (or even possibly causes the water to change its phase, for example, from a liquid water phase to a gaseous steam phase).

In order to achieve the combustion within the furnace 114, fuel and combustion air respectively are supplied to the furnace. More particularly, fuel represented by a first arrow 118 enters the furnace 114 by way of one or more fuel inlets (one of which is shown) 120 in a manner governed by one or more fuel valves (one of which is shown) 122 or, additionally or alternatively, in a manner governed by one or more fuel injectors.

Additionally, combustion air represented by second arrows 124 enters the furnace 114 by way of the rotary air valve/integral burner 108, it being understood that the rotary air valve of the rotary air valve/integral burner 108 can be operated to vary the extent to which such combustion air can enter the furnace. Further as shown, the combustion air arrives at the rotary air valve/integral burner 108 after being directed to the rotary air valve/integral burner by way of a combustion air fan (or blower) 126 that is positioned adjacent to a front head 128 above the rotary air valve/integral burner 108. The combustion air directed to the rotary air valve/integral burner 108 by the combustion air fan 126 actually is a mixture of two components, flue gas and fresh or ambient air. This mixture is generated as follows.

First, as combustion occurs within the furnace 114, exhaust or flue gas represented by third arrows 130 is generated and passes from the furnace, around a rear tube sheet 132 proximate the rear end 110, through the boiler tubes 116 frontward toward the front end 106, and then upward and out of the boiler system 100 by way of an exhaust passage or stack outlet 134. In the present embodiment, a first portion of the flue gas entering the stack outlet 134 proceeds out of the boiler system 100 into an external environment region 146 via the exhaust passage, as represented by fourth arrows 136. However, also in the present embodiment, flue gas recirculation (FGR) is performed, according to which a second portion of the flue gas entering the stack outlet 134 is directed back to the combustion air fan 126 via a passage 137, as represented by fifth arrows 138. The amount of flue gas that passes from the stack outlet (or exhaust passage) 134 to the combustion air fan 126 is determined (at least in part) by actuation of a FGR valve 140.

In addition to the second portion of the flue gas being provided to the combustion air fan 126, the combustion air fan also is supplied with ambient air represented by sixth arrows 142. The ambient air in particular proceeds to the combustion air fan 126 by way of an additional ambient air inlet 144, after entering that inlet from the external environment location 146. In the present embodiment, the amount of ambient air entering the ambient air inlet 144 and arriving at the combustion air fan 126 is not controlled by any separate valve governing the flow of ambient air into or through the ambient air inlet. Rather, the amount of ambient air entering the ambient air inlet 144 and arriving at the combustion air fan 126 is determined (at least indirectly) by other factors, such as the speed of the combustion air fan, the setting of the FGR valve 140, and the setting of rotary air valve of the rotary air valve/integral burner 108. However, in alternate embodiments, there can be present an additional ambient air valve within or along the ambient air inlet 144 that governs (at least partly) ambient air flow.

Thus, the combustion air represented by the second arrows 124 that is directed from the combustion air fan 126 into the furnace 114 via the rotary air valve/integral burner 108 can (depending upon the operational circumstance and the setting of the FGR valve 140) include both a first component represented by the sixth arrows 142 that is ambient (e.g., atmospheric) air obtained from the external environment 146 and also a second component that is the second portion of the flue gas represented by the fifth arrows 138. Although the above description utilizes the reference numerals 118, 124, 130, 136, 138, and 142 to refer to the first, second, third, fourth, fifth, and sixth arrows shown in FIG. 1, for convenience the discussion below in some circumstances utilizes these same reference numerals respectively to refer to the respective fluids or other quantities that are represented by the respective arrows.

It should be appreciated that the relative proportions of ambient air and the flue gas within the combustion air 124 that is actually directed into the furnace 114 by way of the rotary air valve/integral burner 108 depends upon the setting of the FGR valve 140. That is, the ratio of flue gas to ambient air within the combustion air is increased as the FGR valve 140 is opened more and decreased as the FGR valve 140 is closed more. The absolute amount of the combustion air that is directed into the furnace 114 further depends upon the setting (or operation) of the rotary air valve of the rotary air valve/integral burner 108. In the present embodiment, the setting of the FGR valve 140, in terms of the valve being fully opened, fully closed, or partly opened or closed, is determined by a first actuator (or motor) 148, and the setting of the rotary air valve of the rotary air valve/integral burner 108, in terms of the valve being fully opened, fully closed, or partly opened or closed, is determined by a second actuator (or motor) 149. It should be appreciated that the first actuator 148 is at least indirectly coupled to the FGR valve 140 and that the second actuator 149 is at least indirectly coupled to the rotary air valve of the rotary air valve/integral burner 108, even though FIG. 1 does not illustrate direct linkages between these components.

Additionally as shown in FIG. 1, actuation (opening and closing operation) of the FGR valve 140 and rotary air valve of the rotary air valve/integral burner 108 respectively by the first and second actuators 148 and 149 respectively is controlled in response to control signals provided from a $NO_X$ and $O_2$ sensing and control module 150. More particularly, as shown, the $NO_X$ and $O_2$ sensing and control module 150 is connected and in communication with the first actuator 148 controlling the FGR valve 140 by way of a first communication link 152 and connected and in communication with the second actuator 149 controlling the rotary air valve of the rotary air valve/integral burner 108 by way of a second communication link 154.

Further as shown, in the present embodiment, the $NO_X$ and $O_2$ sensing and control module 150 is particularly positioned within the stack outlet 134 so that the module can sense the levels or concentrations of each of $NO_X$ (which again generally encompasses both nitrogen monoxide and nitrogen dioxide) and $O_2$ in the flue gas 130, 136 passing through the exhaust passage. The sensed levels of $NO_X$ and $O_2$ can be indicated for example by way of sensor signals provided from $NO_X$ and $O_2$ gas sensors that are parts of (or in communication with a remainder of) the $NO_X$ and $O_2$ sensing and control module 150. Based upon the sensed levels of $NO_X$ and $O_2$, the $NO_X$ and $O_2$ sensing and control module 150 determines the respective control signals that should be transmitted respectively to the first actuator 148 and second actuator 149 via the first and second communication links 152 and 154, respectively.

Depending upon the embodiment, the above-mentioned control signals determined by the $NO_X$ and $O_2$ sensing and control module 150 can be determined by that module (based at least in part upon the sensed levels of $NO_X$ and $O_2$) by way of any of a variety of processing operations or in any of a variety of manners. Such processing operations or manners of determining the control signals can include, for example, operations involving calculations based upon formulas or consulting one or more look-up tables stored in a memory device associated with the module 150 that stores control signal values that are appropriate for different sensed levels of $NO_X$ and $O_2$. In at least some embodiments, data regarding optimum $O_2$ and $NO_X$ concentrations are determined during boiler commissioning with individual set points through the full modulation range of the burner. Also, in at least some embodiments, the generating of the control signals is performed repeatedly on a real-time basis so as to result in ongoing modulation of positions of the FGR valve 140 and the rotary air valve of the rotary air valve/integral burner 108 (or, depending upon the embodiments, some other valve). Again, during such operation, the generating of the control signals, based at least in part upon the sensed levels of $NO_X$ and $O_2$, can for example include either consulting one or more look-up tables or performing one or more calculations.

The control signal(s) provided over the first communication link 152 to the first actuator 148 particularly govern the opening and closing operation of the FGR valve 140 and thereby control (or at least influence) the amount of flow or flow rate of the flue gas 138 passing via the passage 137 from the stack outlet 134 to the combustion air fan 126. By comparison, the control signal(s) provided over the second communication link 154 to the rotary air valve of the rotary air valve/integral burner 108 particularly govern the opening and closing operation of the rotary air valve and thereby control (or at least influence) the amount of flow or flow rate of the combustion air 124 passing from the combustion air fan 126 to the furnace 114. By controlling each of the setting of the FGR valve 140 and the rotary air valve of the rotary air valve/integral burner 108, it is possible to control the levels, or concentrations, of each of the $NO_X$ and oxygen that are within the flue gas 136.

It should be appreciated that the $NO_X$ and $O_2$ sensing and control module 150 can control the operation of the FGR valve 140 and rotary air valve of the rotary air valve/integral burner 108 in a variety of ways depending upon the desired operational goals and the operational circumstances of the boiler system 100. Among other things, the rotary air valve of the rotary air valve/integral burner 108 can be relatively opened to a greater extent if it is desired that the level or concentration of $O_2$ within the flue gas 136 be greater. Also the rotary air valve of the rotary air valve/integral burner 108 can be relatively closed if it is desired to reduce $O_2$ within the flue gas 136. With respect to the operation of the FGR valve 140 in particular, if the FGR valve 140 is opened more, such that increased flue gas is provided in the combustion air, then this should ultimately result in a reduced level of $NO_X$ in the flue gas output from the boiler at the stack outlet 134. Although it is often the case that, during operation, the FGR valve 140 is opened to some degree so that the combustion air 124 is made up of components of each of the ambient air 142 and flue gas 138, there can also be circumstances in which the FGR valve 140 is entirely closed. In circumstances in which the FGR valve 140 is entirely closed, the combustion air 124 can be made up exclusively of the ambient air 142.

Notwithstanding the above discussion, it should be appreciated that the boiler system 100 can encompass any of a variety of other components in addition to those described above. For example, such components can include various controllers or other control devices, including a firing rate controller 201 and transmitter 199 as described in relation to FIG. 2 below. Also, such components can include other types of sensors or actuators including, for example, a water sensor and flushing actuator described further below.

Figure 2:
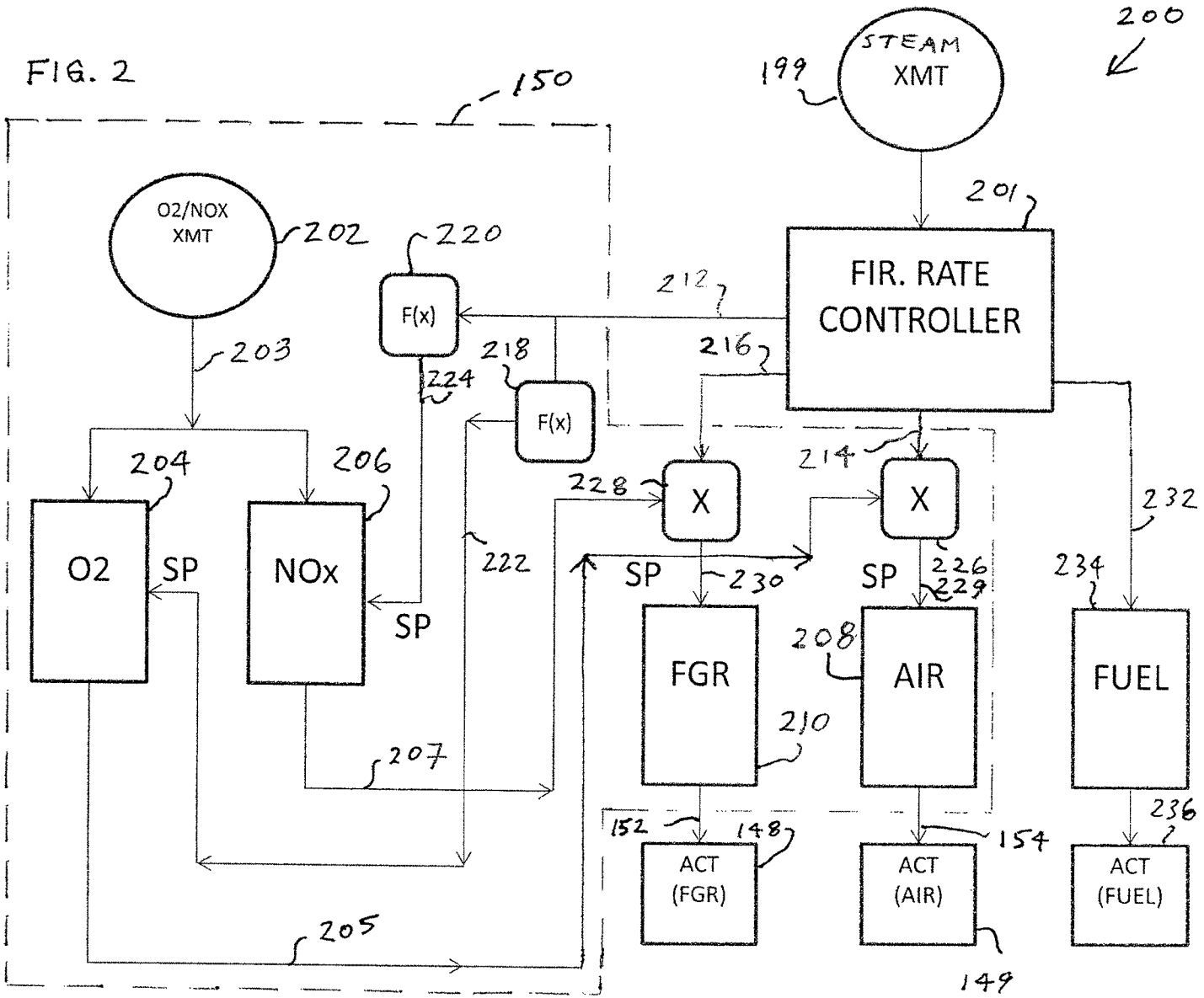
FIG. 2 is a block diagram showing, in schematic form, interrelationships among several control modules and controlled components of the boiler system of FIG. 1, including several components not shown in FIG. 1, which also illustrates aspects of a process of operation of the boiler system.

Turning to FIG. 2, a block diagram 200 is provided to show, in schematic form, interrelationships among several control modules and controlled components forming an overall control system for the boiler system 100 of FIG. 1, including several components not shown in FIG. 1. Consistent with FIG. 1, FIG. 2 shows the $NO_X$ and $O_2$ sensing and control module 150 as being coupled to, and in communication with, each of the first actuator 148 and the second actuator 149 that respectively operate to control the FGR valve 140 and the rotary air valve of the rotary air valve/integral burner 108, respectively, by way of the first communication link 152 and the second communication link 154, respectively. Further, FIG. 2 also shows (in contrast to FIG. 1) that the boiler system 100 includes the firing rate controller 201 that is in communication with, and configured to receive, steam pressure signal(s) from the transmitter 199. Desired steam pressure is set by the operator and is a set point to the firing rate controller 201. As is described further below, the firing rate controller 201 is additionally coupled to the $NO_X$ and $O_2$ sensing and control module 150 and provides set point signals thereto. Although not shown specifically in FIG. 1, it should be appreciated that the firing rate controller 201 and transmitter 199 can be considered to be components of the boiler system 100 nonetheless.

Figure 3:
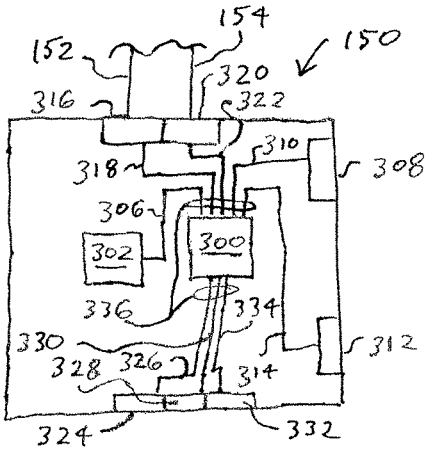
FIG. 3 is an additional schematic diagram showing components of a $NO_X$ and $O_2$ sensing and control module shown in FIG. 2 and employed by the boiler system of FIG. 1, with certain communication links that are in communication with that module also being shown in cutaway.

Further as shown in FIG. 2, in the present embodiment the $NO_X$ and $O_2$ sensing and control module 150 includes multiple submodules. Depending upon the implementation, various ones of the submodules can be implemented as discrete hardware components or as software routines implemented by way of processing or computer devices. Operation and intercommunication of the submodules of FIG. 2 can particularly be considered to constitute aspects of a process of operation of the boiler system 100 overall. FIG. 3, which is described in more detail below, shows one example of hardware components that can be employed as the $NO_X$ and $O_2$ sensing and control module 150. Still referring to FIG. 2, the $NO_X$ and $O_2$ sensing and control module 150 in the present embodiment particularly includes a first submodule that is an $O_2/NO_X$ transmitter 202, which particularly serves to sense $O_2$ and $NO_X$ levels within the stack outlet 134 and provide signals 203 indicative of these sensed levels. As described further below in relation to FIG. 4, in at least some embodiments, the signals 203 at least in part are calibrated/corrected based upon calibration/correction factor information developed by way of a calibration subprocess performed by or in relation to the boiler system 100.

Further, the $NO_X$ and $O_2$ sensing and control module 150 also includes a second submodule that is an oxygen ($O_2$) trim controller 204, a third submodule that is a $NO_X$ trim controller 206, a fourth submodule that is an air controller 208, and a fifth submodule that is a FGR controller 210. As shown, the signals 203 provided from the $O_2/NO_X$ transmitter 202 are particularly sent to the $O_2$ and $NO_X$ trim controllers 204 and 206 and, in some embodiments, the signals 203 can include multiple discrete signals (e.g., independent $O_2$ signals and independent $NO_X$ signals) that are directed toward and received by respective ones of the $O_2$ and $NO_X$ trim controllers. As discussed further below, the firing rate controller 201 sends command(s) to a fuel controller 234 to position a fuel actuator 236 to defined position(s). In at least some embodiments, the fuel controller 234 can be considered to include a fuel sensor that senses the fuel being supplied or other characteristics of the fuel being provided to or utilized by the boiler system.

Also as shown, in the present embodiment, the $NO_X$ and $O_2$ sensing and control module 150 is configured to receive set point signals from the firing rate controller 201 that influence the operation of each of its second, third, fourth, and fifth submodules, that is, each of the oxygen ($O_2$) trim controller 204, the $NO_X$ trim controller 206, the air controller 208, and the FGR controller 210. More particularly, the firing rate controller 201 based upon the steam pressure signals received from the transmitter 199 develops first, second, and third set point signals 212, 214, and 216 that are provided to the $NO_X$ and $O_2$ sensing and control module 150. The first set point signal 212 particularly is provided to first and second function (F(x)) blocks 218 and 220 that in turn output first and second additional set point signals 222 and 224, respectively, that are communicated to the oxygen trim controller 204 and the $NO_X$ trim controller 206, respectively.

By contrast, the second and third set point signals 214 and 216 provided by the firing rate controller 201 respectively are provided to first and second multiplication blocks 226 and 228, respectively. During operation of the boiler system 100, when the oxygen level (concentration) in the flue gases within the stack outlet 134 is measured by the $O_2/NO_X$ transmitter 202 and provided to the oxygen trim controller 204, the oxygen trim controller 204 in turn compares the measured oxygen level in the flue gases with the set point established by the first additional set point signal 222. Then, the oxygen trim controller 204 executes a control algorithm and provides an output signal 205, where the output signal is a correction factor (multiplier) for the set point of the air controller 208.

More particularly, the output signal 205 is communicated to the first multiplication block 226, at which that output signal is multiplied by the second set point signal 214 to generate a first product that is in turn sent as a first product set point signal 229 to the air controller 208. If the multiplier (represented by the output signal 205) is greater than one (1), the air controller 208 will send control signals via the second communication link 154 to the second actuator 149 so as to cause the rotary air valve of the rotary air valve/integral burner 108 to open and thereby increase the flow of the combustion air 124 to the furnace 114. Alternatively, if the multiplier is less than one, the air controller 208 will cause the rotary air valve of the rotary air valve/integral burner 108 to close so as to decrease flow of the combustion air 124.

Relatedly, when the $NO_X$ level (concentration) in the flue gases within the stack outlet 134 is measured by the $O_2/NO_X$ transmitter 202 and provided to the $NO_X$ trim controller 206, the $NO_X$ trim controller in turn compares the measured $NO_X$ level in the flue gases with the set point established by the second additional set point signal 224. Then, the $NO_X$ trim controller 206 executes a control algorithm and provides an output signal 207, where the output signal is a correction factor (multiplier) for the set point of the FGR controller 210. More particularly, the output signal 207 is communicated to the second multiplication block 228, at which that output signal is multiplied by the third set point signal 216 to generate a second product that is in turn sent as a second product set point signal 230 to the FGR controller 210.

If the multiplier (represented by the output signal 207) is greater than one (1), the FGR controller 210 will send control signals via the first communication link 152 to the first actuator 148 so as to cause the FGR valve 140 to open and thereby increase flow of the flue gas 138 to the combustion air fan 126. Alternatively, if the multiplier is less than one, the FGR controller 210 will send control signals via the first communication link 152 to the first actuator 148 so as to cause the FGR valve 140 to close and thereby decrease the flow of the flue gas 138 to the combustion air fan 126 (and typically correspondingly decrease the flow of the combustion air 124 into the furnace 114).

Although the above description explains how the firing rate controller 201 outputs the first, second, and third set point signals 212, 214, and 216 to the $NO_X$ and $O_2$ sensing and control module 150 and thereby influences operation of the rotary air valve of the rotary air valve/integral burner 108 and the FGR valve 140, it should be appreciated that the firing rate controller 201 can also provide set point signals to other recipients as well depending upon the embodiment. For example, in the present embodiment, the firing rate controller 201 additionally outputs a fourth set point signal 232 for receipt by the fuel controller 234 that in turn can provide control signals for receipt by the fuel actuator 236 that controls the operation/positioning of the fuel valve 122 (see FIG. 1), and thereby governs the flow of the fuel 118 into the boiler system 100. Further, it should also be appreciated that, although the first function block 218, second function block 220, first multiplication block 226, and second multiplication block 228 are shown in FIG. 2 as being distinct from the oxygen trim controller 204, the $NO_X$ trim controller 206, the air controller 208, and the FGR controller 210, the blocks can also respectively be viewed as constituting respective portions of the oxygen trim controller 204, the $NO_X$ trim controller 206, the air controller 208, and the FGR controller 210, respectively.

Turning now to FIG. 3, although FIG. 2 provides one schematic representation of functional submodules of the $NO_X$ and $O_2$ sensing and control module 150, FIG. 3 also illustrates in more detail example internal components (particularly hardware components) of the $NO_X$ and $O_2$ sensing and control module 150. More particularly, in the present embodiment, the $NO_X$ and $O_2$ sensing and control module 150 includes a processing device 300 and a memory device 302 that are coupled and in communication with one another by way of a communication link 306. Computer software suitable for implementing operations of any one or more (and typically all) of the oxygen trim controller 204, the $NO_X$ trim controller 206, the air controller 208, and the FGR controller 210, as well as the first and second function blocks 218 and 220 and the first and second multiplication blocks 226 and 228, can be stored on the memory device 302 and operated on the processing device 300.

Depending upon the embodiment, the processing device 300 can take any of a variety of forms including, for example, a microprocessor, a microcontroller, an application-specific integrated circuit (ASIC), a programmable logic controller (PLC), or a programmable logic device (PLD). Also, the memory device 302 can take a variety of forms including random access memory (RAM) and read only memory (ROM). Although the module 150 is shown to include the single processor 300 and the single memory device 302, in alternate embodiments multiple processors and/or multiple memory devices of any of a variety of types can be employed. For example, in alternate embodiments, there can be present first, second, third, and fourth processors that are configured to serve as the oxygen trim controller 204, the $NO_X$ trim controller 206, the air controller 208, and the FGR controller 210, respectively. Additionally, in some alternate embodiments, the firing rate controller 201 can be provided by a processing device that also serves as each of the controllers 204, 206, 208, and 210. Also for example, in some alternate embodiments, the processing and memory functionality can be performed at least in part by way of a single device that includes both processing and memory capabilities (e.g., a processor-in-memory or PIM).

In addition, the $NO_X$ and $O_2$ sensing and control module 150 further includes a $NO_X$ sensor 308 and an $O_2$ sensor 312, which are respectively coupled to and in communication with the processing device 300 by way of communication links 310 and 314, respectively. The $NO_X$ sensor 308 and $O_2$ sensor 312 are the components that allow the $NO_X$ and $O_2$ sensing and control module 150 to detect the levels of $NO_X$ and $O_2$ within the flue gas 130 passing through the stack outlet 134 within which the module 150 is situated. The $O_2/NO_X$ transmitter 202 described in relation to FIG. 2 can be understood as encompassing each of the $NO_X$ sensor 308 and the $O_2$ sensor 312.

Further, the $NO_X$ and $O_2$ sensing and control module 150 in the present embodiment includes first and second input/output (I/O) ports 316 and 320, respectively, which are respectively coupled to and in communication with the processing device 300 by way of communication links 318 and 322, respectively. The first I/O port 316 is coupled to the first communication link 152 (shown in cutaway) and outputs control signals provided by the processing device 300 via the communication link 318 for receipt by the first actuator 148, and thereby controls the operation (e.g., the open/closed status) of the FGR valve 140. The second I/O port 320 is coupled to the second communication link 154 (shown in cutaway) and outputs control signals provided by the processing device 300 via the communication link 322 for receipt by the second actuator 149, and thereby controls the operation (e.g., the open/closed status) of the rotary air valve of the rotary air valve/integral burner 108.

Additionally, the $NO_X$ and $O_2$ sensing and control module 150 also includes third, fourth, and fifth input/output (I/O) ports 324, 328, and 332, respectively, which are respectively coupled to and in communication with the processing device 300 by way of communication links 326, 330, and 334, respectively. Although not shown in FIG. 3, it should be appreciated that the I/O ports 324, 328, and 332 can respectively be configured to receive (or transmit) signals, and in the present embodiment for example can be configured to receive the first, second, and third set point signals 212, 214, and 216 from the firing rate controller 201 (see FIG. 2). Although the communication links 306, 310, 314, 318, 322, 326, 330, and 334 of FIG. 3 are shown as discrete links or wires, it should be appreciated that collectively those links can be considered a collective group of links 336 and in some cases can take the form of a communication bus.

Notwithstanding the illustration provided by FIG. 3, it should be appreciated that, depending upon the embodiment, the $NO_X$ and $O_2$ sensing and control module 150 can include one or more other components in addition to (or instead of) those described above. For example, in some other embodiments, the $NO_X$ and $O_2$ sensing and control module can include other I/O devices including, for example, communications devices or user interfaces by which signals or information can be output or received by the module. In some cases, the module can include user interface devices such video or touch screens, keyboards, mouse devices, and other devices allowing for interaction with people. Although the embodiment of FIG. 3 particularly includes the $NO_X$ and $O_2$ sensors 308 and 312, in other embodiments one or more other sensors can also (or instead) be present. Some such other sensors are described in further detail below.

Additionally, although in the present embodiment the first and second communication links 152 and 154 are wired links, it should be appreciated that these communications links (and other links envisioned herein, such as links between the firing rate controller 201 and the $NO_X$ and $O_2$ sensing and control module 150) can in other embodiments be wireless communication links. In such embodiments, one or more of the I/O ports 316, 320, 324, 328, and 332 can be or include wireless transceivers and can employ any of a variety of wireless communications protocols including, for example, Bluetooth communications, Wi-Fi communications, etc. Also, in some additional embodiments, the module 150 can conduct communications (via wired or wireless communications technologies) with one or more other devices or components, including one or more other devices or components that are not part of the boiler system, such as a remote monitoring and/or control device. Additionally, in some embodiments, one or more communications between the $NO_X$ and $O_2$ sensing and control module and one or more other devices or components can be achieved via the internet or World Wide Web.

Additionally, although FIG. 3 particularly illustrates internal components of the $NO_X$ and $O_2$ sensing and control module 150, identical or similar internal components can be employed in other components or devices of the boiler system 100. For example, the firing rate controller 201 can also employ a processing device such as the processing device 300, a memory device such as the memory device 302, and one or more I/O ports such as the I/O ports 316, 320, 324, 328, and 332. Also, given such an arrangement, the firing rate controller 201 can be integrated, as a single module, with the transmitter 199, which can replace one of the sensors 308 and 312 shown in FIG. 3.

Although the present disclosure is intended to encompass numerous different embodiments and numerous manners of operation, it is particularly envisioned that at least one example embodiment encompassed herein will involve the generation and use of the output signals 205 and 207 as correction factors in which those output signals/correction factors take on particular values depending upon the operational circumstances. More particularly, in the present example embodiment, the values of the output signals 205 and 207 (and correction factors represented thereby) each can be unity (one) when the sensed $NO_X$ and $O_2$ levels satisfy the desired levels. Also, in this embodiment, the output signal 205 can take on values of greater than unity (>1) if it is determined that the rotary air valve should be opened to allow for more combustion air flow, and can take on values of less than unity (<1) if it is determined that the rotary air valve should be closed to allow for less combustion air flow. Additionally, in this embodiment, the output signal 207 can take on values of greater than unity (>1) if it is determined that the FGR valve should be opened to allow for more FGR flow, and can take on values of less than unity (<1) if it is determined that the FGR valve should be closed to allow for less FGR flow.

The boiler system 100 of FIGS. 1, 2, and 3 as described above, including the control system 200, particularly is configured to allow for sensing of $NO_X$ and $O_2$ levels and controlling of the statuses of the rotary air valve and flue gas valve so as to allow for controlled flue gas recirculation (FGR), controlled combustion air flow, and (at least indirectly) controlled ambient air introduction. Such operation both allows for the composition of the combustion air 126 to be varied but also allows for the ultimate composition of the flue gas 130 (and flue gas 136 exiting the stack outlet 134 into the external environment) to be varied in terms of $NO_X$ and $O_2$ levels.

By virtue of such operation, the control system 200 including the module 150 can ensure or enhance the likelihood that the furnace 114 of the boiler system 100 is running properly in a finely tuned manner and otherwise operate in an advantageous manner. More particularly in this regard, the emission sensor signals ($NO_X$ and $O_2$ sensor signals) are utilized by the sensing and control module 150 to monitor and then control the combustion process, which can improve combustion stability. A further benefit is that the boiler system can then be run in a manner that better meets regulatory requirements (e.g., emissions regulations setting forth $NO_X$ limits or regarding $NO_X$ output). Further, operation in this manner can also result in more reliable boiler system operation and in boiler system operation that is more efficient (e.g., by avoiding or reducing margins in combustion levels so as to reduce or avoid excessive electrical usage, and improve fuel to steam/water operating efficiency). Additionally, in at least some embodiments or circumstances, the boiler system can be operated in a real-time manner, to achieve real-time control over $NO_X$ levels so as to achieve desired $NO_X$ levels.

Given the sensing and control functionality provided by way of the control system 200 including the module 150, and enhanced functionality of the boiler system 100 overall due to the operation of the control system 200 including the module 150 in relation to the rotary air valve and flue gas valve and related components, the boiler system can be considered a "smart" boiler system. Additionally, although the above-described functionality of the boiler system 100 particularly involving control of the rotary air valve and FGR valve is consistent with one example embodiment of a smart boiler system achieving enhanced functionality through such sensing and control operations, the present disclosure is intended to encompass numerous other embodiments (e.g., other embodiments of "smart" boiler or heating systems) as well in which a boiler or other heating system can include or perform additional functionality in addition to (or instead of) that described above. For example, in some additional embodiments, the $NO_X$ and $O_2$ sensing and control module 150 detects $NO_X$ and $O_2$ levels and then utilizes this detected information to provide control signals to other components associated with the boiler. Further for example in this regard, in some such embodiments, the module 150 (based upon the sensed $NO_X$ and $O_2$ levels) produces and directs one or more control signals to the furnace 114 of the boiler system that affect the combustion processes occurring therein.

Also, in at least some boiler system embodiments encompassed herein, sensing and control functionality can also be achieved in relation to other aspects of boiler system operation such as those having to do with the water that is heated or boiled during operation. In this regard, referring again to FIG. 1 and as already mentioned above, the boiler system 100 of FIG. 1 includes a water sensor 159 that is positioned within the boiler and a flushing actuator 160 that is positioned outside the boiler. The water sensor 159 particularly allows for sensing of one or more characteristics of the water therewithin (and thus can also be considered a water characteristic sensor) or within a heat exchanger of the boiler system, and provides signals indicative of such sensed characteristics to the flushing actuator 160. The flushing actuator 160 in turn, based upon those signals, enables flushing operation of the water out of the boiler by way of a conduit or pipe 161 that is shown schematically in FIG. 1.

In the present embodiment, the water sensor 159 and flushing actuator 160 operate independently of the levels of $NO_X$ and $O_2$ that are present or sensed within the boiler system 100, and operate independently of the $NO_X$ and $O_2$ sensing and control module 150. In at least some alternative embodiments, however, the $NO_X$ and $O_2$ sensing and control module 150 additionally can be coupled (e.g., by way of an additional wired or wireless communication link or links, not shown) to engage in communications with the water sensor 159 and/or flushing actuator 160, and/or the water sensor 159 and/or flushing actuator 160 can operate at least indirectly based upon the levels of $NO_X$ and $O_2$ that are present or sensed within the boiler system 100. In at least some such embodiments in which the $NO_X$ and $O_2$ sensing and control module 150 is coupled to and in communication with the water sensor 159 and/or flushing actuator 160, the $NO_X$ and $O_2$ sensing and control module 150 can include programming or software based upon which the processing device 300 operates (and the memory device 302 can store such programming, software, and other information) to allow for the $NO_X$ and $O_2$ sensing and control module 150 to monitor and control the water sensor 159 and/or flushing actuator 160.

It should be appreciated that the exact characteristic or characteristics of the water that is or are sensed by the water sensor 159 can vary depending upon the embodiment or implementation. Indeed, any of a variety of characteristics can be of interest depending upon the embodiment. In the present example embodiment, it is recognized that the boiler chemistry/water quality of a boiler can be affected by contaminants that can build up during operation of the boiling (particularly during steaming operation of the boiler). Given this concern, in the present embodiment, the water sensor 159 particularly senses, and includes a sensor for sensing, a total dissolved solids (TDS) level of the water within the boiler. Nevertheless, in other embodiments, one or more other characteristics of the water can also (or instead) be sensed including, for example, metals content, acidity or temperature. Based upon what is sensed, the flushing actuator 160 can also then further be operated to perform flushing of the water from the boiler, in a manner that reduces or eliminates the contaminant levels within the boiler.

The exact manner in which the boiler system 100 operates in relation to the water sensor 159 and flushing actuator 160 can vary depending upon the embodiment or implementation. In at least one example embodiment, water characteristic(s) of interest (e.g., TDS level) is or are detected by way of the water sensor 159, and then the control module determines whether the detected characteristic(s) is or are indicative of a need to perform flushing of the water from the boiler. If it is determined that there is a need to perform flushing, then the flushing actuator 160 (or a control module associated therewith) determines whether there is any other reason why flushing should be delayed and, if not, then the flushing actuator causes flushing to occur.

It should be appreciated that, although flushing operations can be performed at any time, flushing operations typically are performed at times when the boiler system 100 is not actively performing combustion. This can occur either when the boiler system is entirely "off" or during periods when, even though the boiler system remains operational, combustion has ceased temporarily. Therefore, in at least some embodiments, it may be appropriate to delay flushing for example if the water temperature is currently too hot, or if the boiler system 100 is still performing combustion but it is anticipated that the boiler system combustion will be ending in the near future.

Therefore, with these features, the boiler system 100 particularly is capable of additionally providing functionality in which the water sensor 159 provides signals concerning one or more water characteristics and those signals are received by the flushing actuator 160 (or a control module associated therewith) so as to allow for monitoring of the water characteristics. Based upon such monitoring, the flushing actuator 160 (or control module associated therewith) in turn causes flushing to occur. In particular, the flushing actuator 160 can be configured to govern and optimize the flushing or "blowdown" frequency. Such operation typically results in less flushing overall by comparison with conventional boiler systems, which in turn results in reduced energy loss and improved water quality relative to conventional designs.

Figure 4:
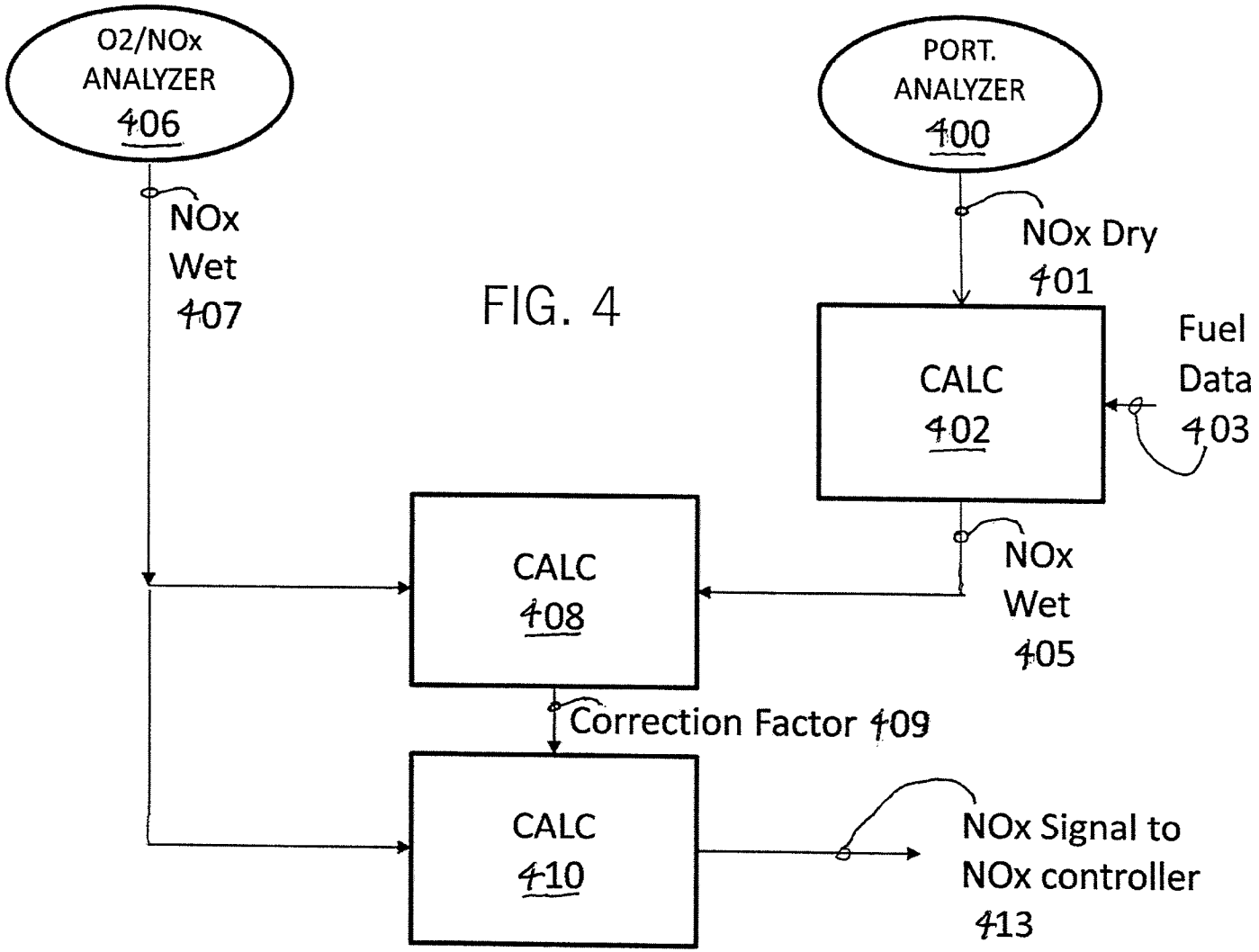
FIG. 4 is a schematic signal flow diagram showing example steps of a subprocess of involving calibration and the use of calibrated/corrected information, as can be employed by the boiler system of FIGS. 1-3 and be considered an additional portion of the process of operation of the boiler system illustrated by FIG. 2.

Turning to FIG. 4, it should additionally be appreciated that at least some embodiments of boiler systems encompassed herein operate in accordance with a process that includes a calibration subprocess. The calibration subprocess is desirable because, typically, industry and regulatory bodies normally exclude water vapors when defining sensor operation (e.g., $NO_X$ sensor operation) but in practice such sensors are often operated in circumstances in which water vapors are present in the flue gases. That is, boiler systems such as the boiler system 100 are typically operated under somewhat wet conditions (i.e., operation on a wet basis), but the sensors that can be used for reference are extractive type and measure $NO_X$ and O2 concentrations excluding water vapor (dry basis). In view of these considerations, in the present embodiment, in order to compare readings, correction between wet and dry readings are performed.

FIG. 4 is provided to show, in the manner of a signal flow diagram, the calibration subprocess. As mentioned above, calibration can be performed at any of a variety of times during operation of a boiler system and particularly can be performed during burner commissioning and also periodically with regular intervals thereafter. In the present embodiment, sensor calibration can be performed immediately at the start of a given instance of operation of a boiler system such as the boiler system 100. As shown, the subprocess of calibration particularly includes a sequence of events that begins with a step 400 at which data is received from a portable $NO_X$ analyzer data. The portable analyzer's reading(s) (which are calibrated against a gas with known $NO_X$ and $O_2$ values) are taken within close proximity to the $O_2/NO_X$ transmitter 202 (and particularly the $NO_X$ sensor thereof). Also, typically the portable analyzer's readings are taken at times when the burner is being fired in a normal mode. As illustrated by a signal 401, the information received at and then provided by the portable analyzer are $NO_X$ dry values.

Further as shown, the calibration subprocess additionally involves a calculation step 402, which can be considered as being performed by the $NO_X$ and $O_2$ sensing and control module 150. In order to perform the calculation step 402, a further step 403 is performed at which fuel data is received and provided. The fuel data can be provided, for example, by way of a fuel sensor that is part of (or associated with) a fuel controller 234 as discussed above. At the calculation step 402, the $NO_X$ and $O_2$ sensing and control module 150 based upon the received $NO_X$ dry values and fuel data calculates $NO_X$ wet values, as represented by an output signal 405.

With the $NO_X$ wet values as represented by the signal 405, it is possible to develop correction factors by taking into account actual sensed $NO_X$ values provided from $O_2/NO_X$ transmitter 202 (taken at the same or substantially the same times as the readings were obtained at the portable $NO_X$ analyzer). Thus, as illustrated by the FIG. 4, at a step 406, which is shown to be a $O_2/NO_X$ analyzer step, the $O_2/NO_X$ transmitter 202 receives data—particularly $NO_X$ value data—and this is provided as a signal 407. Given that the $O_2/NO_X$ transmitter 202 is operating under conditions where there is moisture present, the data provided as the signal 407 is $NO_X$ wet data. Therefore, based upon the $NO_X$ wet data received by way of the signal 405 and the $NO_X$ wet data received by way of the signal 407, the $NO_X$ and $O_2$ sensing and control module 150 is able to calculate correction factors at a step 408, which can be output as a signal 409.

The above-described steps and signals 400, 401, 402, 403, 405, 406, 407, 408, and 409 represent the steps of the calibration subprocess in the present embodiment. It is by virtue of this subprocess that the boiler system 100 and particularly the $NO_X$ and $O_2$ sensing and control module 150 thereof develops calibration (correction factor) information that can be employed during further or ongoing operation of the boiler system 100. It should be appreciated that the steps and signals 400, 401, 402, 403, 405, 406, 407, 408, and 409 can be performed repeatedly or continuously over a period of time with respect to numerous values sensed by the portable $NO_X$ analyzer. In general, the correction factors that are identified or determined are factors that allow for correction of $NO_X$ values from a wet to dry basis.

In addition to illustrating the steps and signals corresponding to the calibration subprocess, FIG. 4 also illustrates how the calibration (correction factor) information can be used during operation of the boiler system 100 to control the rotary air valve and FGR valve as described above. More particularly in this regard, FIG. 4 shows a step 410, at which the $NO_X$ and $O_2$ sensing and control module 150 receives both the correction factor information as represented by the signal 409 as well as $NO_X$ wet data as represented by the signal 407. The receiving of the correction factor information represented by the signal 409 can be understood as encompassing the receipt of such information from the memory device 302 of the $NO_X$ and $O_2$ sensing and control module 150 (at which such information can be stored during the calibration subprocess).

In at least some embodiments, the receiving of the correction factor information can involve selection of one or more of the available correction factors stored at the memory device 302 that are appropriate for an operational circumstance or sensed characteristic such as, for example, a sensed moisture level within the flue gases (as can be sensed by a moisture sensor of the boiler system, not shown). The correction factors can be selected, for example, from a look-up table containing all correction factors that is stored at the memory device 302. By comparison, the receiving of the $NO_X$ wet data represented by a signal 407 can be understood as receiving real-time data that is obtained at the step 406 by the $O_2/NO_X$ transmitter 202 during operation of the boiler system 100.

Additionally as shown, the step 410 additionally includes calculating and providing signals 413 that are provided to the $NO_X$ trim controller 206 and that constitute calibrated/corrected sensed $O_2/NO_X$ signals. In this respect, with respect to FIG. 2, the step 410 can be viewed as an operation that is also performed by the $O_2/NO_X$ transmitter 202, and the signals 413 can be considered as corresponding to the signals 203 of FIG. 2. Thus, through the use of the correction factor information obtained as a result of the calibration subprocess, the additional sensed information (particularly $NO_X$ values sensed in real time) provided by the $O_2/NO_X$ transmitter 202 can be used to achieve desired, or enhanced, control over the rotary air valve and FGR valve settings. Further, depending upon the embodiment, additional actions can be taken in regard to the sensing, processing, calculating, or outputting of data. For example, in some cases, based upon readings of the sensed $O_2/NO_X$ signals, correction factors are applied to the displayed $O_2/NO_X$ values. Also, in some embodiments, the $NO_X$ and $O_2$ sensing and control module 150 can provide calculations and display of $NO_X$ and $O_2$ corrected to the referenced excess air level.

Notwithstanding the above description, it should be appreciated that the present disclosure is also intended to encompass numerous other types boiler systems and arrangements in addition to those described above. For example, although FIG. 1 concerns a fire tube boiler system that is an integral burner boiler system having an integral burner, the present disclosure is also intended to encompass fire tube boiler systems that are gun burner boiler systems, as well as water tube boiler systems. In this regard, FIG. 5 particularly illustrates an additional boiler system 500 that is a gun burner boiler system, in accordance with an example alternate embodiment of the present invention. Also, FIG. 6 particularly illustrates a further boiler system 600 that is a water tube boiler system, in accordance with another example alternate embodiment of the present invention.

Figure 5:
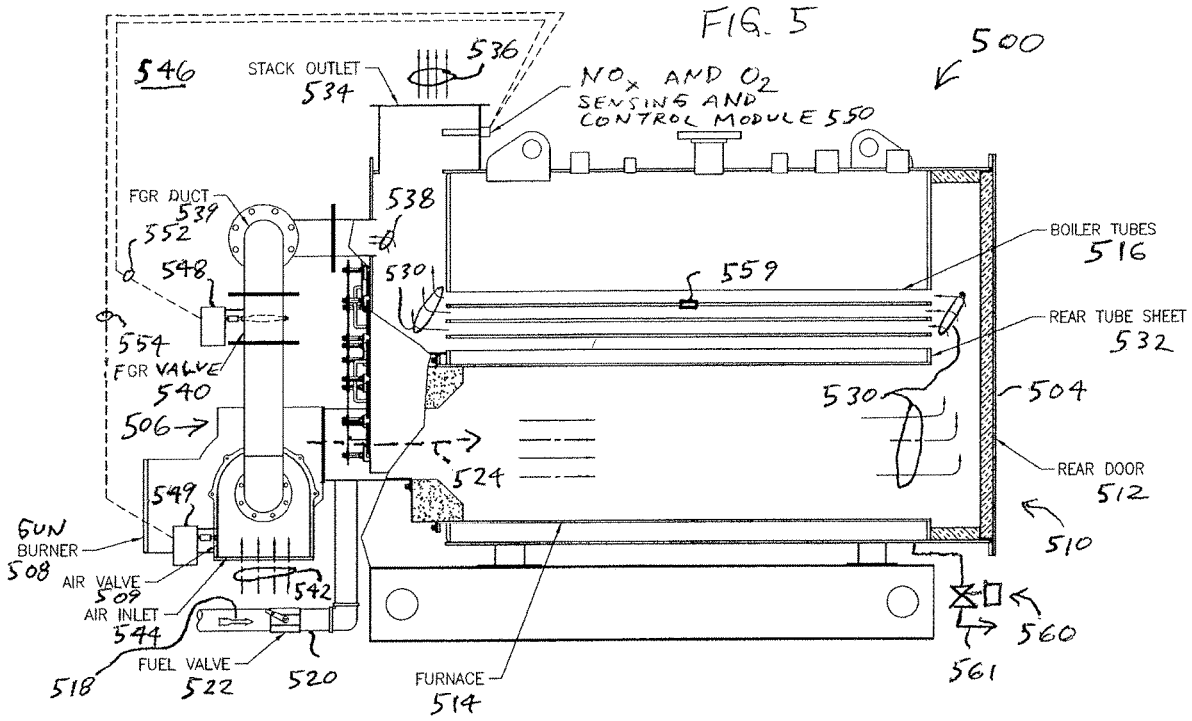
FIG. 5 is a schematic diagram showing an additional example boiler system, which in this example is a gun burner boiler system, in accordance with an additional example embodiment encompassed herein.

With respect to FIG. 5, it should be appreciated that the boiler system 500 includes numerous components and features that are identical or substantially similar in configuration and function to like components and features of the boiler system 100 of FIG. 1. In particular, the boiler system 500 includes a housing 504 with a rear end 510 and rear door 512, a furnace 514, boiler tubes 516, a fuel inlet 520 communicating fuel 518, a fuel valve 522, a rear tube sheet 532, and a stack outlet 534 that are respectively identical or substantially similar to the corresponding housing 104, rear end 110, rear door 112, furnace 114, boiler tubes 116, fuel inlet 120, fuel 118, fuel valve 122, rear tube sheet 132, and stack outlet 134, respectively, of the boiler system 100 of FIG. 1 (also, a water sensor 559, flushing actuator 560, and conduit 561 shown in FIG. 5 can also be considered to be identical to the water sensor 159, flushing actuator 160, and conduit 161 shown in FIG. 1).

Further, it can be seen in FIG. 5 that, as with the furnace 114, the furnace 514 outputs exhaust or flue gas represented by arrows 530 that correspond to the arrows 130, and that the flue gas follows a path that is substantially similar or identical to the path followed by the flue gas in the boiler system 100, namely, a path in which the flue gas proceeds from the furnace around the rear tube sheet 532 and through the boiler tubes 516 and then passes into and through the stack outlet 534. Also, in a manner substantially similar to that of the boiler system 100, a first portion of the flue gas proceeds out the stack outlet 534 into an external environment 546, as represented by arrows 536, and a second portion of the flue gas represented by arrows 538 flows out of the stack outlet 534 down a different path as determined by a FGR valve 540 that is governed by a first actuator 548.

Notwithstanding these many similarities between the boiler systems 100 and 500, it can further be seen that the boiler system 500 differs from the boiler system 100 in that the boiler system 500 includes a front end 506 that is different in configuration from the front end 106 of the boiler system 100. More particularly, the boiler system 500 at the front end 506 includes a gun burner 508 that is distinct from an air valve 509, and lacks any combination rotary air valve/integral burner as is present in the boiler system 100. Further, although the second portion of the flue gas represented by the arrows 538 is directed toward the gun burner 508, it is necessary for that second portion of the flue gas to proceed down an FGR duct 539 to reach the gun burner (with the FGR valve 540 being positioned midway along the length of that duct).

Also, although the boiler system 500 includes an air inlet 544 that allows ambient air represented by arrows 542 to enter the boiler system 500 from the external environment 546, the air inlet 544 is positioned below the gun burner 508 rather than proximate the stack outlet 134 as in the boiler system 100. Further, although in the boiler system 100 the rotary air valve of the rotary air valve/integral burner 108 as controlled by the first actuator 149 determines the flow of combustion air 124 into the furnace 114, with the combustion air 124 being a combination of the second portion of the exhaust or flue gas 138 and the ambient air 142, in the boiler system 500 the air valve 509 as controlled by a first actuator 149 specifically only controls the flow of the ambient air into the gun burner 508.

Accordingly, in the boiler system 500 (and unlike in the boiler system 100), the FGR valve 540 and air valve 509 are dedicated valves that respectively govern the flow of flue gas and ambient air into the gun burner. The gun burner 508, upon receiving the second portion of the flue gas as determined by the FGR valve 540 and the ambient air as determined by the air valve 509, does not further restrict or control the flow of the combination of those gases. Rather, the gun burner 508 merely passes along all of that flue gas and ambient air as combustion air into the furnace 514, as represented by an arrow 524. (Although not shown in FIG. 5, in at least some embodiments an air fan or blower corresponding to the fan 126 of FIG. 1 can be provided at or proximate the gun burner that serves to direct the combination of flue gas and ambient air into the furnace 514, albeit such a blower would not affect the relative proportions of the flue gas and ambient air.)

As for control over the operation of the boiler system 500, as shown the boiler system 500 includes a $NO_X$ and $O_2$ sensing and control module 550 that is coupled to first and second actuators 548 and 549 by way of first and second communication links 552 and 554, respectively. It should be understood that the boiler system 500 also can include other control elements such as the firing rate controller 201 and transmitter 199 described above, as well as can operate in conjunction with the water sensor 559 and flushing actuator 560 in a manner identical or substantially similar to that described above in regard to the boiler system 100 of FIG. 1 and FIG. 5. Also, a calibration subprocess identical or substantially similar to that described above in relation to FIG. 4 can be employed in relation to the boiler system 500. In these added respects, the boiler system 500 is substantially similar to the boiler system 100.

Nevertheless, it should also be appreciated that the manner of operation, and the programming or software and other information forming the basis of the manner of operation, of the $NO_X$ and $O_2$ sensing and control module 550 (and possibly other control components or other associated devices of the boiler system 500) can differ from that of the $NO_X$ and $O_2$ sensing and control module 150. As already discussed above, the air valve 509 of the boiler system 500 strictly governs the flow of ambient air into the boiler system, in contrast to the rotary air valve of the rotary air valve/integral burner 108, which governs the flow of the combustion air that includes both ambient air and the flue gas. More particularly, given the differences between actuation of the air valve 509 in the boiler system 500 relative to the rotary air valve of the rotary air valve/integral burner 108 of the boiler system 100, operation of the boiler system 500 can be particularly suited for the air valve 509 rather than the rotary air valve. For example, to the extent that look-up tables or other sources of stored data are consulted in determining control signals during the operation of the boiler system 500, that stored data will typically be different than the stored data that will be consulted in determining control signals during the operation of the boiler system 100.

Figure 6:
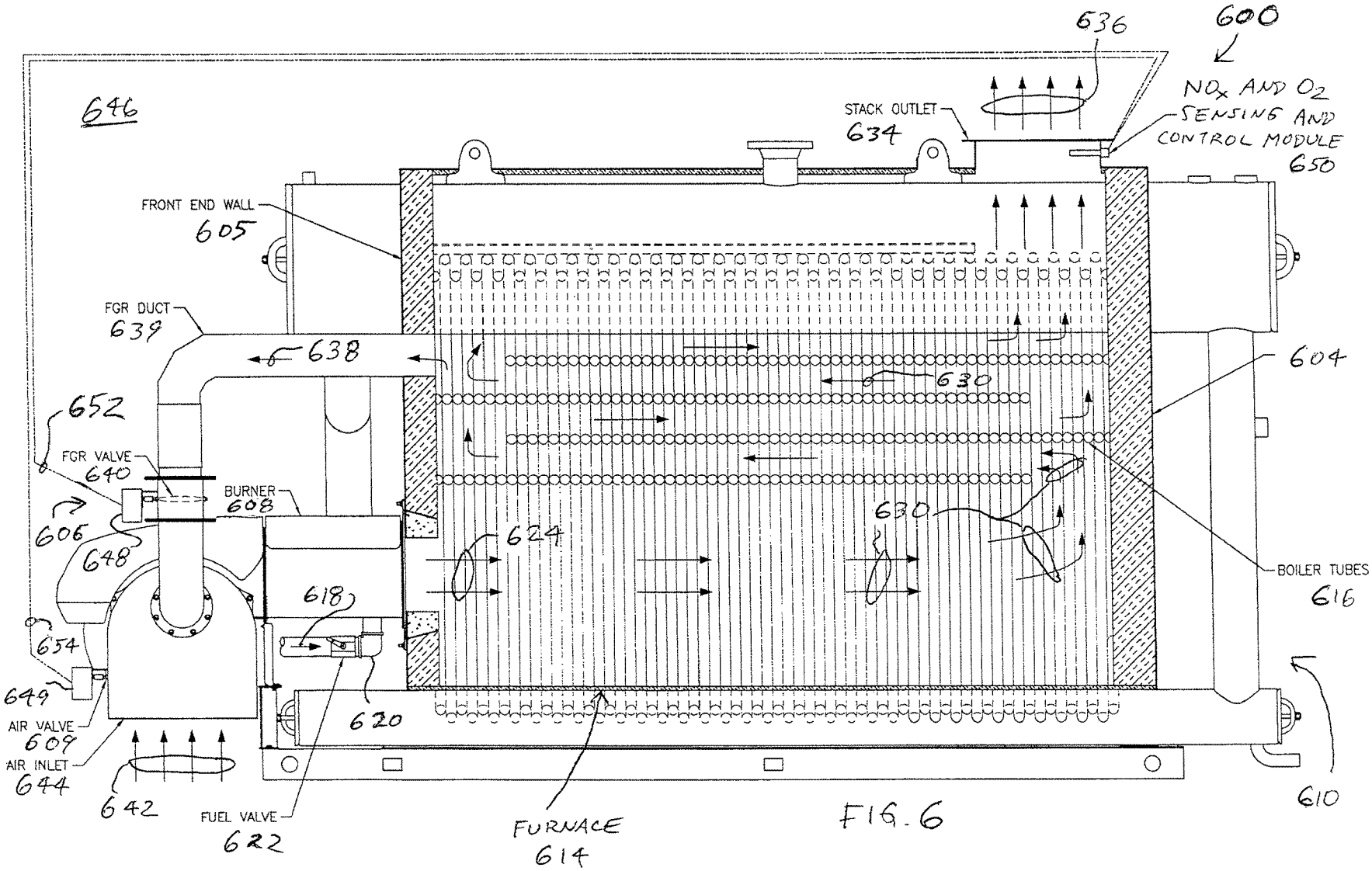
FIG. 6 is a schematic diagram showing an additional example boiler system, which in this example is a water tube boiler system, in accordance with an additional example embodiment encompassed herein.

With respect to FIG. 6, it should be appreciated that the boiler system 600 includes numerous components and features that are identical or substantially similar in configuration and function to like components and features of the boiler system 500 of FIG. 5. In particular, the boiler system 600 includes a housing 604 with a rear end 610 (albeit no rear door is shown), a furnace 614, boiler tubes 616, a fuel inlet 620 communicating fuel 618, and a fuel valve 622 that respectively are identical or substantially similar to the corresponding housing 504 with rear end 510, furnace 514, boiler tubes 516, fuel inlet 520, fuel 518, and fuel valve 522, respectively, of the boiler system 500 of FIG. 1. However, it should be understood that the boiler tubes 616 in the boiler system 600 serve to convey water rather than gases (or "fire") as is conveyed by the boiler tubes 516 of the boiler system 500 (or the boiler tubes 116 of the boiler system 100).

Further, it can be seen in FIG. 6 that, as with the furnace 514, the furnace 514 outputs exhaust or flue gas represented by arrows 630 that correspond to the arrows 530. As in the furnace 514, the flue gas within the furnace 614 follows a path that proceeds from the furnace toward the rear end 610 and through the boiler tubes 616 and then ultimately passes into and through a stack outlet 634. However, in contrast to the stack outlet 534 of the boiler system 500 of FIG. 5, the stack outlet 634 is positioned toward the rear of the boiler system 600, and the exhaust or flue gas represented by the arrows 630 takes a more circuitous path between the boiler tubes 616 so as to reach the stack outlet 634. More particularly, it can be seen that the exhaust or flue gas represented by the arrows 630 passes from the rear end 610 to a front end wall 605 proximate a front end 606 of the boiler system 600, and then back to the rear end 610, between the boiler tubes 616, multiple times before reaching the stack outlet.

Additionally as shown, a first portion of the flue gas proceeds out the stack outlet 634 into an external environment 646, as represented by arrows 636, and a second portion of the flue gas represented by arrows 638 flows down a different path through a FGR duct 639 as determined by a FGR valve 640 that is governed by a first actuator 648. Although the FGR duct 639 and FGR valve 640 (and first actuator 648) respectively are substantially similar in configuration to the FGR duct 539 and FGR valve 540 (and first actuator 548), respectively, due to the positioning of the stack outlet 634 proximate the rear end 610, the first and second portions of the flue gas are separated from one another well before reaching the stack outlet 634.

In addition to the above features, FIG. 6 additionally shows that the boiler system 600 at the front end 606 includes a gun burner 608 that is distinct from an air valve 609, as is the case for the boiler system 500 of FIG. 5, and lacks any combination rotary air valve/integral burner as is present in the boiler system 100. Further, the boiler system 600 includes an air inlet 644 that allows ambient air represented by arrows 642 to enter the boiler system 600 from the external environment 646, with the air inlet 644 being positioned below the gun burner 608. The air valve 609 as controlled by a first actuator 649 specifically only controls the flow of the ambient air into the gun burner 608. Thus, the arrangement by which ambient air enters the boiler system 600 is substantially similar to that of the boiler system 500.

Accordingly, substantially similar to the boiler system 500 (and in contrast to the boiler system 100), in the boiler system 600 the FGR valve 640 and air valve 609 are dedicated valves that respectively govern the flow of flue gas and ambient air into the gun burner 608. The gun burner 608, upon receiving the second portion of the flue gas as determined by the FGR valve 640 and the ambient air as determined by the air valve 609, does not further restrict or control the flow of the combination of those gases. Rather, the gun burner 608 merely passes along all of that flue gas and ambient air as combustion air into the furnace 614, as represented by arrows 624. (Although not shown in FIG. 6, in at least some embodiments an air fan or blower corresponding to the fan 126 of FIG. 1 can be provided at or proximate the gun burner that serves to direct the combination of flue gas and ambient air into the furnace 614, albeit such a blower would not affect the relative proportions of the flue gas and ambient air.)

With respect to the operation of the boiler system 600, the boiler system 600 includes a $NO_X$ and $O_2$ sensing and control module 650 that is coupled to first and second actuators 648 and 649 by way of first and second communication links 652 and 654, respectively. It should be understood that the boiler system 600 also can include other control elements such as the firing rate controller 201 and transmitter 199 described above. As for the manner of operation, and the programming or software and other information forming the basis of the manner of operation, of the $NO_X$ and $O_2$ sensing and control module 650 (and possibly other control components or other associated devices of the boiler system 600) can be identical or substantially similar to that described above in regard to the boiler system 500. Also, a calibration subprocess identical or substantially similar to that described above in relation to FIG. 4 can be employed in relation to the boiler system 500.

Nevertheless, as with the boiler system 500, there can be some differences in operation of the boiler system 600 relative to the boiler system 100 arising from the use, in the boiler system 600, of the air valve 609 rather than the rotary air valve of the rotary air valve/integral burner 108 of the boiler system 100. In particular, to the extent that look-up tables or other sources of stored data are consulted in determining control signals during the operation of the boiler system 600, that stored data will typically be different than the stored data that will be consulted in determining control signals during the operation of the boiler system 100. Further, it should be noted that, although FIG. 6 does not show the boiler system 600 as including any water sensor or flushing actuator, in some further alternate embodiments, such components can be present and the boiler system 600 can operate in conjunction with those components in a manner that is identical or substantially similar to that described above in regard to the boiler systems 100 and 500 of FIG. 1 and FIG. 5.

Notwithstanding the above description, it should further be appreciated that the present disclosure is intended to encompass numerous other types of systems, arrangements, and operational processes and subprocesses in addition to those described above. Among other things, although the above discussion is focused upon boiler systems, the present disclosure is also intended to encompass other types of heating systems that operate by way of combustion processes but do not necessarily operate in a manner that involves boiling or the generation of steam. Also, it should be appreciated that the present disclosure is also intended to encompass a variety of "smart" boiler systems or other heating systems that take into account sensed signals of any of a variety of types and control any of a variety of components or operational characteristics of those boiler systems or other heating systems. Further, the present disclosure is additionally intended to encompass boiler systems or other heating systems that employ calibration processes or subprocesses to generate, directly or indirectly (or entirely or in part), correction factors, control signals, or other quantities or signals. Such calibration processes or subprocesses can allow for calibrating of the boiler systems or other heating system to take into account characteristics such as moisture levels or any of a variety of other characteristics.

Also, the present disclosure is intended to encompass a variety of boiler systems or other heating systems that employ other arrangements of sensors and/or controllers including sensors or controllers that are distributed or arranged differently within the boiler systems or other heating systems, and including a variety of arrangements of sensors and/or controllers that communicate with one another by way of any of a variety of communication technologies including wired and wireless communication technologies. Although the above-described embodiments of the boiler system employ $NO_X$, $O_2$, and water (e.g., TDS level) sensors, in other embodiments still one or more further sensors can be employed in addition to (or instead of) these sensors. For example, in other embodiments, carbon dioxide ($CO_2$) sensors can also be employed.

It should be recognized that at least some embodiments of the boiler systems and other heating systems described herein are "smart" systems that can provide any of a variety of operational advantages. For example, at least some of these systems make it possible to achieve (or achieve to a high degree) operation in which desired levels of $NO_X$ or $O_2$ are attained in the flue gases, or where contaminants within the water (or other fluid) to be boiled or heated during operation of the systems are kept to a reduced level, where particular water chemistry characteristics are attained, or where flushing operation is performed at desired times or in manners that reduce the amounts of heat wasted due to such flushing operation. Also, at least some of these boiler or other heating systems are configured to achieve self-tuning and/or self-maintaining operation, and/or to achieve predictive maintenance.

In reference to the preceding paragraphs and the aforementioned figures, although various embodiments of the present invention have been described above, it should be understood that embodiments have been presented by way of example, and not limitation. A person of ordinary skill in the art will recognize that there are various changes that can be made to the present invention without departing from the spirit and scope of the present invention. Therefore, the invention should not be limited by any of the above-described example embodiments, but should be defined only in accordance with the following claims and equivalents of the claimed invention presented herein. Further, it is specifically intended that the present disclosure not be limited to the embodiments and illustrations contained herein, but include modified forms of those embodiments including portions of the embodiments and combinations of elements of different embodiments as come within the scope of the following claims.

What is claimed is:

1. A boiler system comprising:

a furnace including a burner, at which flue gas is generated as a result of combustion;

an exhaust passage by which at least a first portion of the flue gas can exit the furnace;

an air passage configured to receive ambient air;

a flue gas recirculation (FGR) passage configured to allow for at least a second portion of the flue gas to be mixed with the ambient air so as to produce combustion air;

a flue gas valve that is positioned along the FGR passage and having a flue gas valve setting adjustable by way of a flue gas valve actuator, wherein the flue gas valve setting controls an amount of flue gas passing from the exhaust passage into the FGR passage to form the second portion of flue gas;

a $NO_X$ and $O_2$ sensing and control module comprising at least one processing device;

the $NO_X$ and $O_2$ sensing and control module further comprising a $O_2/NO_X$ transmitter which partially serves to sense $O_2$ and $NO_X$ levels within the exhaust passage and provide sensor signals indicative of these sensed levels;

an additional valve having an additional valve setting adjustable by way of an additional valve actuator, wherein the additional valve setting controls a flow of the combustion air to the burner;

the at least one processing device coupled to the flue gas valve actuator, and the additional valve actuator;

a portable $NO_X$ analyzer configured to take readings within the exhaust passage within close proximity to the $O_2/NO_X$ transmitter and provide signals indicative of these readings; and a fuel sensor;

wherein the at least one processing device is configured to generate a plurality of control signals that are provided to the flue gas valve actuator and additional valve actuator to adjust the flue gas valve setting and the additional valve setting, the control signals being based at least indirectly upon a plurality of the sensor signals received from the $O_2/NO_X$ transmitter;

wherein the at least one processing device additionally is configured to generate a plurality of correction factors by way of a calibration process and to utilize one or more of the correction factors in determining one or more of the control signals;

wherein the at least one processing device of the $NO_X$ and $O_2$ sensing and control module is configured to generate the correction factors based at least in part upon $NO_X$ dry data provided by the portable $NO_X$ analyzer and fuel data provided by the fuel sensor, and additionally based upon $NO_X$ wet data provided by the $O_2/NO_X$ transmitter.

2. The boiler system of claim 1, wherein the at least one processing device includes a $NO_X$ trim controller that is configured to determine an output signal based upon at least one of the correction factors, and wherein at least one of the control signals is based at least indirectly upon the output signal.

3. The boiler system of claim 2, further comprising a firing rate controller and a fuel controller that includes or operates in association with the fuel sensor, wherein the firing rate controller is configured to output a plurality of additional control signals, wherein at least a first of the additional control signals is provided to the $NO_X$ trim controller and at least a second of the additional control signals is provided to the fuel controller.

4. The boiler system of claim 3, further comprising:

an additional sensor configured to sense an additional characteristic of the boiler system; and a heat exchanger, wherein the additional characteristic is a water characteristic pertaining to water within the heat exchanger, and wherein the additional sensor is at least indirectly in communication with the at least one processing device, and wherein the water characteristic is a total dissolved solids concentration within the water.

5. The boiler system of claim 1, wherein the $O_2/NO_X$ transmitter comprises a $NO_X$ gas sensor configured to sense a $NO_X$ gas level within the first portion or the second portion of the flue gas and to provide a first of the sensor signals indicative of the sensed $NO_X$ gas level, and an oxygen gas sensor configured to sense an oxygen gas level within the boiler system and to provide a second of the sensor signals indicative of the sensed oxygen gas level.

6. The boiler system of claim 5, wherein each of the $NO_X$ gas sensor and the oxygen gas sensor is positioned within the exhaust passage.

7. The boiler system of claim 5, wherein the $NO_X$ gas sensor and the oxygen gas sensor are positioned at substantially coincident locations.

8. The boiler system of claim 5, wherein the $NO_X$ and $O_2$ sensing and control module is positioned within the exhaust passage.

9. The boiler system of claim 1, further comprising a blower configured to direct the combustion air toward the furnace for the combustion therein, wherein the boiler system has a first boiler configuration that is a fire tube boiler configuration, a second boiler configuration that is a gun burner configuration, or a third boiler configuration that is a water tube boiler configuration.

10. A method of operating a boiler system, the method comprising:

performing a calibration process using a portable $NO_X$ analyzer and at least one processing device of a $NO_X$ and $O_2$ sensing and control module to determine one or more correction factors, the $NO_X$ and $O_2$ sensing and control module further comprising a $O_2/NO_X$ transmitter, and the portable $NO_X$ analyzer being configured to take readings within close proximity to the $O_2/NO_X$ transmitter and provide signals indicative of these readings, wherein the performing of the calibration process includes the at least one processing device receiving $NO_X$ dry data provided by the portable $NO_X$ analyzer;

operating a blower to direct gases including both ambient air and flue gas toward a burner assembly of the boiler system;

performing combustion within the burner assembly;

receiving at least some additional flue gas at an exhaust passage;

sensing a $NO_X$ gas concentration and an oxygen gas concentration in the additional flue gas at or near a boiler outlet by way of the $O_2/NO_X$ transmitter, the $O_2/NO_X$ transmitter comprising a $NO_X$ gas sensor and an oxygen gas sensor;

receiving, at the $NO_X$ and $O_2$ sensing and control module, fuel data provided by a fuel sensor;

receiving, at the at least one processing device, a first sensor signal and a second sensor signal respectively from the $NO_X$ gas sensor and the oxygen gas sensor, respectively, which are indicative of the $NO_X$ gas concentration and the oxygen gas concentration, respectively;

selecting at the at least one processing device a first of the one or more correction factors generated based at least in part upon the $NO_X$ dry data provided by the portable $NO_X$ analyzer, the fuel data provided by the fuel sensor, and additionally based upon $NO_X$ wet data provided by the $O_2/NO_X$ transmitter;

generating a plurality of control signals at the at least one processing device based at least indirectly upon the first and second sensor signals, wherein at least one of the control signals is generated based at least in part upon the selected first correction factor;

sending from the $NO_X$ and $O_2$ sensing and control module either a first of the control signals or a first additional control signal based at least indirectly upon the first control signal to a flue gas valve positioned along a flue gas recirculation passage coupled at least indirectly with the blower so as to adjust a first setting of the flue gas valve and thereby adjust a first amount of the additional flue gas that is supplied to the blower; and sending from the $NO_X$ and $O_2$ sensing and control module either a second of the control signals or a second additional control signal based at least indirectly upon the second control signal to an additional valve so as to adjust a second setting of the additional valve and control a second amount of additional ambient air supplied to the blower.

11. The method of claim 10, wherein the sending of the second control signal or second additional control signal includes the sending of the second additional control signal to the additional valve, and wherein the additional valve is an ambient air valve positioned along an ambient air passage coupled at least indirectly with the blower, and wherein at least one of the first and second control signals is based upon at least two of the first sensor signal, the second sensor signal, and a third sensor signal.

12. The method of claim 11, wherein if the sensed $NO_X$ gas concentration is above a first desired level, then the first control signal generated by the at least one processing device is configured to cause the flue gas valve to open to a greater degree so as to increase the first amount of the additional flue gas that is supplied to the blower, or wherein if the sensed oxygen gas concentration is above a second desired level, then the second control signal generated by the at least one processing device is configured to cause the ambient air valve to close to a greater degree so as to reduce the second amount of the additional ambient air that is supplied to the blower.

13. The method of claim 11, further comprising, prior to the operating of the blower, causing the flue gas valve and ambient air valve to take on respective initial positions upon a commencement of the operating of the blower.

14. The method of claim 10, wherein the performing of the calibration process includes the at least one processing device performing steps of:

receiving at least some of the fuel data from the fuel sensor;

determining one or more calculated $NO_X$ wet values based upon the $NO_X$ dry data and the fuel data; and generating the one or more correction factors based upon the one or more calculated $NO_X$ wet values and one or more sensed $NO_X$ wet values comprised by the $NO_X$ wet data.

15. The method of claim 14, wherein the generating of the control signals is performed repeatedly on a real-time basis so as to result in ongoing modulation of positions of the flue gas valve and the additional valve, and wherein the generating of the control signals includes either consulting one or more look-up tables or performing one or more calculations based at least indirectly upon the first and second sensor signals.

16. The method of claim 15, further comprising sensing an additional characteristic of the boiler system by way of an additional sensor, wherein the additional characteristic is a water characteristic of at least some water within a heat exchanger of the boiler system, wherein the additional sensor is a total dissolved solid sensor, wherein a third sensor signal is communicated at least indirectly from the additional sensor to the at least one processing device, and wherein the control signals include a third of the control signals that can be sent to a third controlled device of the boiler system.

17. A control system for a boiler system, the control system comprising:

a $NO_X$ and $O_2$ sensing and control module comprising:

at least one processing device, a $O_2/NO_X$ transmitter, the $O_2/NO_X$ transmitter comprising a $NO_X$ gas sensor configured to provide a first sensor signal indicative of a sensed $NO_X$ gas concentration and an oxygen gas sensor configured to provide a second sensor signal indicative of a sensed oxygen gas concentration;

a memory device coupled at least indirectly to the at least one processing device;

a flue gas valve actuator coupled at least indirectly to the at least one processing device, wherein the flue gas valve actuator adjusts a flue gas valve setting to control an amount of flue gas passing from the exhaust passage into a flue gas recirculation (FGR) passage;

an air valve actuator coupled at least indirectly to the at least one processing device, wherein the air valve actuator adjusts an air valve setting to control an amount of combustion air flowing to a burner;

a fuel sensor; and a portable $NO_X$ analyzer configured to take readings within close proximity to the $O_2/NO_X$ transmitter and provide signals indicative of these readings;

wherein the $NO_X$ and $O_2$ sensing and control module is configured to generate first and second control signals at least indirectly based upon the first and second sensor signals and to transmit the first and second control signals respectively to the flue gas valve actuator and the air valve actuator, respectively, so as to cause the flue gas valve actuator and the air valve actuator, respectively, to be actuated, and wherein either the first control signal or the second control signal is generated at least indirectly based upon both of the first and second sensor signals, and further based upon at least one correction factor determined at least in part based upon fuel data provided by the fuel sensor and at least in part based upon $NO_X$ dry data provided by the portable $NO_X$ analyzer, and $NO_X$ wet data provided by the $NO_X$ gas sensor.

18. The control system of claim 17, wherein the at least one processing device generates one or both of the first and second control signals based upon at least some information stored in the memory device that includes the at least one correction factor.

* * * * *